US008981652B2

(12) United States Patent
Kim

(10) Patent No.: US 8,981,652 B2
(45) Date of Patent: Mar. 17, 2015

(54) APPARATUS AND METHOD FOR COMPENSATING CURRENT DEVIATION

(71) Applicant: Samsung Electronics Co., Ltd., Gyeonggi-do (KR)

(72) Inventor: Sun Ki Kim, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 119 days.

(21) Appl. No.: 13/738,672

(22) Filed: Jan. 10, 2013

(65) Prior Publication Data

US 2013/0175935 A1 Jul. 11, 2013

(30) Foreign Application Priority Data

Jan. 11, 2012 (KR) ..... 10-2012-0003354

(51) Int. Cl.
*H05B 33/08* (2006.01)

(52) U.S. Cl.
CPC ..... *H05B 33/0845* (2013.01); *H05B 33/0827* (2013.01)
USPC ..... 315/185 R; 315/192; 315/224

(58) Field of Classification Search
CPC ..... H05B 37/00; H05B 37/02; H05B 33/00; H05B 33/02; H05B 33/0803; H05B 33/0806; H05B 33/0833; H05B 33/0845
USPC ..... 315/185 R, 192, 291, 307, 224; 345/39, 345/82, 102
See application file for complete search history.

(56) References Cited

U.S. PATENT DOCUMENTS

| | | | | |
|---|---|---|---|---|
| 2010/0177127 | A1 | 7/2010 | Akiyama et al. | |
| 2012/0169250 | A1 * | 7/2012 | Tsai et al. | 315/294 |
| 2012/0256894 | A1 * | 10/2012 | Jang et al. | 345/211 |

FOREIGN PATENT DOCUMENTS

| | | | |
|---|---|---|---|
| JP | 2010-109006 | A | 5/2010 |
| JP | 2010-161264 | A | 7/2010 |
| KR | 2009-0015609 | A | 2/2009 |

* cited by examiner

*Primary Examiner* — David H Vu
(74) *Attorney, Agent, or Firm* — McDermott Will & Emery LLP

(57) ABSTRACT

An apparatus and method for compensating for a current deviation are provided. A current is applied through a light emitting diode (LED) array to which LEDs are connected. A current deviation is compensated among each respective string of the LED array using at least one constant current circuit connected to each of the respective strings.

16 Claims, 4 Drawing Sheets

APPARATUS AND METHOD FOR COMPENSATING CURRENT DEVIATION

CROSS-REFERENCE TO RELATED APPLICATION

This application claims the benefit of priority to Korean Patent Application No. 10-2012-0003354, filed on Jan. 11, 2012, in the Korean Intellectual Property Office, the disclosure of which is incorporated herein by reference.

TECHNICAL FIELD

The present application relates to an apparatus and method for compensating for a current deviation of a light emitting diode (LED) array connected with a circuit.

BACKGROUND

A light emitting diode (LED) is preferred and popularized as an environment-friendly product.

The LED is manufactured by a semiconductor manufacturing process. Presently, research and development on the LED is being conducted actively.

Recently, due to various positive features of the LED, interest in the LED for lighting, having optical characteristics suitable for replacing conventional incandescent bulbs, is increasing. Accordingly, products in which the LED replaces a fluorescent lamp or incandescent bulb in conventional lighting systems are being put on the market.

Nowadays, LED lighting systems having brightness comparable to a level of conventional lighting systems are being developed. However, several research projects are still being conducted in many fields including an LED, a package, an optical system including the LED, and an LED control circuit.

Additionally, use of a high-output and high-brightness LED is increasing as an external pilot lamp of a car, for safer driving.

LED lamps for cars include an LED head lamp (H/L), a rear combination lamp (RCL), a center high mounted stop lamp (CHMSL), a daytime running lamp (DRL), a position lamp, and the like. An LED package mounting the RCL and the DRL occupies a main part.

With the increase in use of the LEDs for cars, when a plurality of LEDs is applied, a small number of LEDs are serially connected into strings and a plurality of the strings of LEDs is connected in parallel.

When constituting an LED array using the above parallel configuration, a current difference may be generated between respective parallel strings due to a current of the serially connected LEDs.

Since the LED is driven by a current, a constant current supply is necessary to maintain constant brightness.

Generally, a constant current driving integrated circuit (IC) or a microprocessor is used to achieve a constant current driving circuit. However, such devices may lead to an increase in manufacturing costs.

In general LED arrays, although a constant current source is used, a current flowing to each respective string may be different due to a deviation of current ($V_f$) of the LEDs connected to each of the respective strings.

SUMMARY

According to an aspect of the present application, there is provided a current deviation compensating circuit. The circuit includes a light emitting diode (LED) array to which a plurality (i.e. two or more) of LEDs are connected. At least one constant current circuit is connected to each respective string of the LED array to compensate for a current deviation among each of the respective strings.

The at least one constant current circuit may set a current amount to be applied to each of the respective strings.

The at least one constant current circuit may control a power supply so that a current amount to be applied to each of the respective strings is uniform.

The respective strings of the at least one LED array are connected in parallel.

The at least one constant current circuit may be a constant current circuit driven through an application of external power.

The at least one constant current circuit may be an LED driving current circuit.

The at least one constant current circuit may compensate for a brightness deviation among each of the respective strings.

According to another aspect of the present application, there is provided a current deviation compensating method. The method includes the step of applying a current through a light emitting diode (LED) array to which a plurality (i.e. two or more) LEDs are connected. A current deviation is compensated among respective strings of the LED array using at least one constant current circuit connected to each of the respective strings.

The current deviation compensating method may further include the step of setting a current amount to be applied to the respective strings using the at least one constant current circuit.

The current deviation compensating method may further include the step of controlling a power supply so that a current amount to be applied to the respective strings is uniform using the at least one constant current circuit.

The current deviation compensating method may further include compensating for a brightness deviation among the strings using at least one constant current circuit.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

These and/or other aspects, features, and advantages of the present application will become apparent and more readily appreciated from the following description of the examples, taken in conjunction with the accompanying drawings of which.

DETAILED DESCRIPTION

Figure 1:
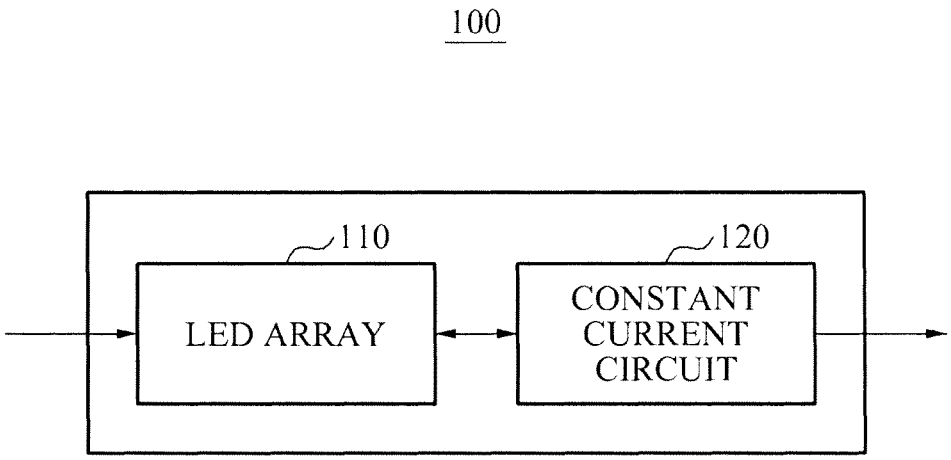
FIG. 1 is a block diagram illustrating a structure of a current deviation compensating circuit according to an example of the present application.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

In the description of the present invention. if detailed descriptions of related disclosed art or configuration are determined to unnecessarily make the subject matter of the present invention obscure, they will be omitted. Terms to be used below are defined based on their functions in the present invention and may vary according to users, user's intentions, or practices. Therefore, the definitions of the terms should be determined based on the entire specification.

Reference will now be made in detail to the examples of which are illustrated in the accompanying drawings, wherein like reference numerals refer to the like elements throughout.

FIG. 1 is a block diagram illustrating a structure of a current deviation compensating circuit 100 according to an embodiment of the present invention.

Referring to FIG. 1, the current deviation compensating circuit 100 may include a light emitting diode (LED) array 110 to which at least one LED is connected, and at least one constant current circuit 120 connected to string(s) of the LED array to compensate for a current deviation of each string.

Hereinafter, a method for compensating for the current deviation will be described with reference to FIG. 2.

Figure 2:
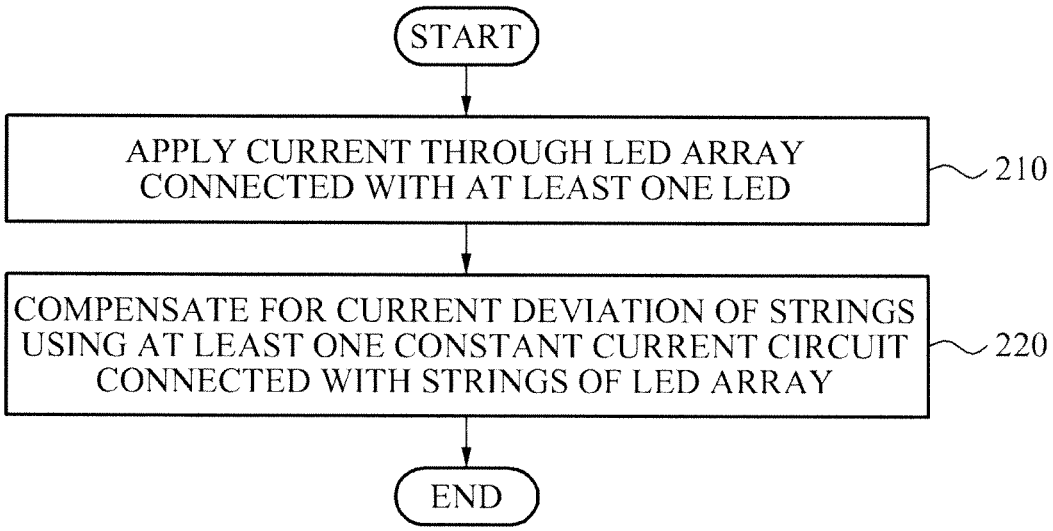
FIG. 2 is a flowchart illustrating a method for compensating for a current deviation according to an example of the present application.

FIG. 2 is a flowchart illustrating a method for compensating for a current deviation according to an example of the present application.

Referring to FIG. 2, the current deviation compensating circuit 100 applies a current through an LED array 110 to which at least one LED is connected, in operation 210.

The current deviation compensating circuit 100 is supplied with a constant current from a constant current supply device (not shown). The constant current is supplied to the LED array 110 so that the at least one LED maintains a constant brightness.

According to an aspect of the present application, the constant current supply device generates a constant current control signal in accordance with a driving control signal input to drive a load, and generate a constant current corresponding to the constant current control signal.

In general LED arrays, although a constant current source is used, a current flowing in each respective string may be different due to a current deviation among the LEDs connected to each of the respective strings. Accordingly, since a current flowing in each of the respective strings is different in the LED array, brightness of the at least one LED connected to each of the respective strings may also be different. The current deviation compensating circuit 100 may minimize the current deviation among parallel arrays by applying a constant current feedback circuit to the LED array.

In operation 220, the compensating circuit 100 may compensate for the current deviation of each of the respective strings using the at least one constant current circuit 120 connected to each of the respective strings of the LED array.

The at least one constant current circuit 120 may set a current amount to be applied to each of the respective strings.

The at least one constant current circuit 120 may control the current amount to be uniform.

That is, the current deviation compensating circuit 100 may connect a small constant current circuit to each of the respective strings, from which the current deviation may occur, in the LED array connected to a circuit including a constant current source. thereby setting a current amount to be applied to each of the respective strings. Accordingly, a constant current may flow without causing the current deviation. By compensating for the current deviation, the current deviation compensating circuit 100 may accordingly compensate for an error caused by a brightness deviation.

Figure 3:
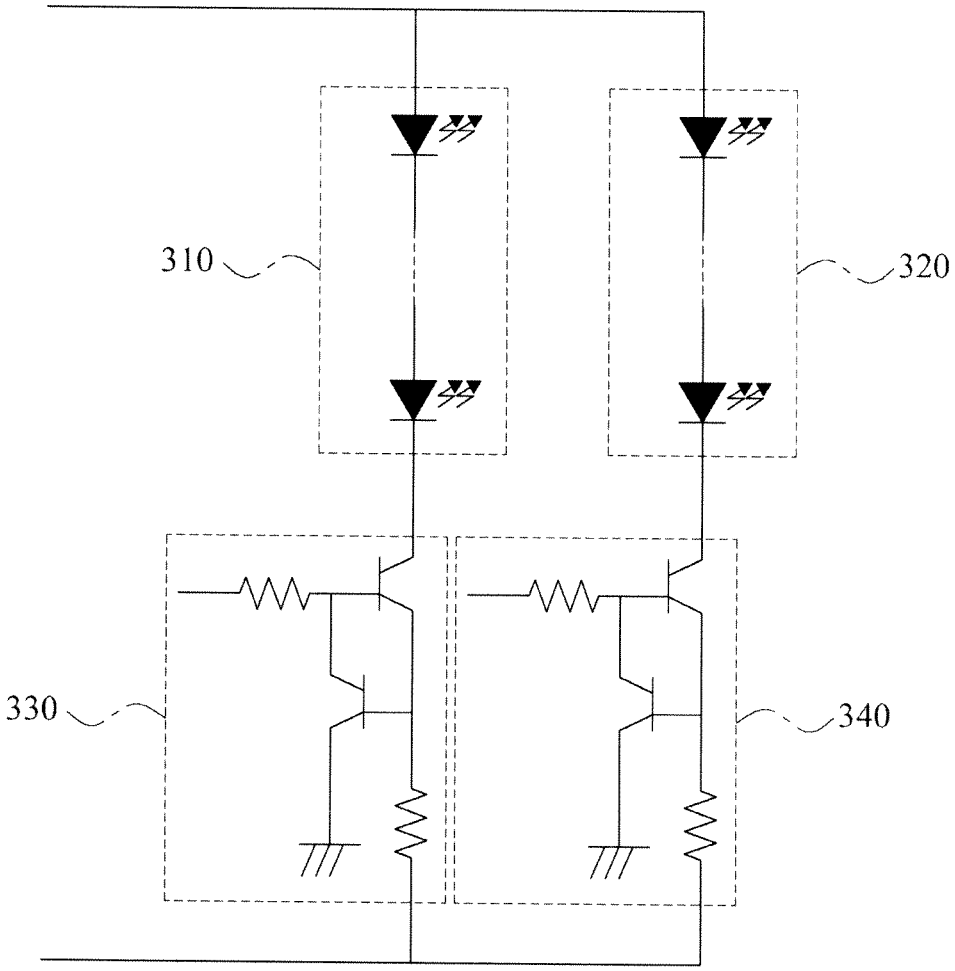
FIGS. 3 and 4 are circuit diagrams illustrating actual examples of a current deviation compensating circuit according to examples of the present application.
Figure 4:
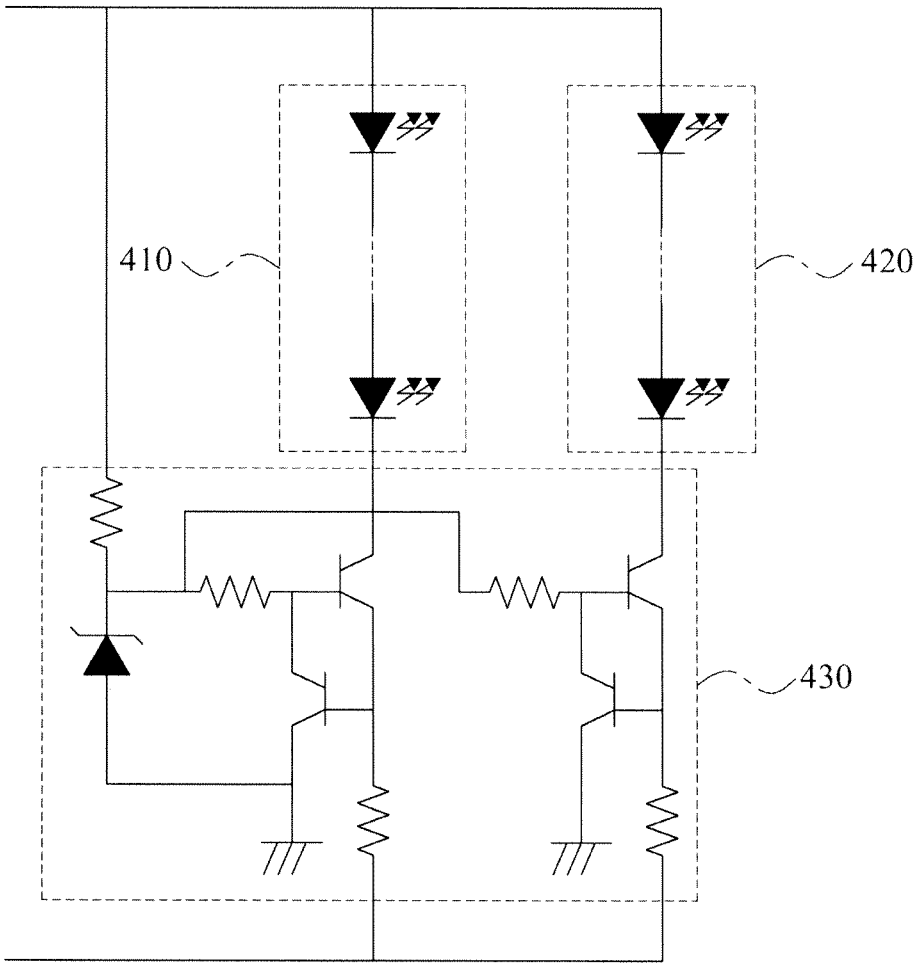

FIGS. 3 and 4 illustrate actual examples of a current deviation compensating circuit according to examples of the present application.

Referring to FIG. 3, at least one LED array 110 may include constant current circuits 330 and 340 driven by external power, to which strings 310 and 320 are connected in parallel, respectively.

For example, the constant current circuits 330 and 340 may apply external power of about 5 volts (V) direct current (DC) for driving a circuit, and control a current deviation of the strings 310 and 320.

Referring to FIG. 4, the at least one constant current circuit 120 may compensate for the current deviation of strings 410 and 420 using an LED driving current circuit 430.

For example, the at least one constant current circuit 120 may use an LED driving current to drive a circuit. A structure shown in FIG. 4 may omit a dedicated input line.

The at least one constant current circuit 120 may compensate for a brightness deviation of each of the respective strings 410 and 420.

The current deviation compensating apparatus 100 may compensate for the brightness deviation of the LEDs of the LED array by compensating for the deviation of current applied to each of the respective strings.

Since the brightness deviation is compensated, the current deviation compensating apparatus 100 may improve quality of products employing LED(s). For example, light distribution performance of a car may be increased.

According to the examples of the present application, a deviation of current flowing through each respective string of an LED array may be compensated for.

Also, a brightness deviation caused by a voltage applied to each respective string of an LED array may be compensated for.

In addition, the current deviation among parallel arrays may be minimized by applying a constant current feedback circuit to the LED array.

While the foregoing has described what are considered to be the best mode and/or other examples, it is understood that various modifications may be made therein and that the subject matter disclosed herein may be implemented in various forms and examples. and that the teachings may be applied in numerous applications, only some of which have been described herein. It is intended by the following claims to claim any and all applications, modifications and variations that fall within the true scope of the present teachings.

What is claimed is:

1. A current deviation compensating circuit comprising:

at least one light emitting diode (LED) array to which a plurality of strings of LEDs are connected; and a plurality of constant current circuits connected to each respective string of the LED array to compensate for a current deviation among each of the respective strings;

wherein the constant current circuits of the plurality of LED strings are controlled through a common input line to respective ones of the constant current circuits.

2. The current deviation compensating circuit of claim 1, wherein the plurality of constant current circuits are configured to set a current amount to be applied to each of the respective strings.

3. The current deviation compensating circuit of claim 1, wherein the plurality of constant current circuits are configured to maintain a uniform current amount applied to each of the respective strings.

4. The current deviation compensating circuit of claim 1, wherein each of the respective strings of the at least one LED array are connected in parallel.

5. The current deviation compensating circuit of claim 4, wherein the plurality of constant current circuits are a constant current circuits driven by application of external power.

6. The current deviation compensating circuit of claim 4, wherein the plurality of constant current circuits are an LED driving current circuits.

7. The current deviation compensating circuit of claim 1, wherein the plurality of constant current circuits are configured to compensate for a brightness deviation among each of the respective strings.

8. A current deviation compensating method, the method comprising steps of:

applying a current through at least one light emitting diode (LED) array to which a plurality of strings of LEDs are connected; and compensating for a current deviation among each respective string of the LED array using a plurality of constant current circuits connected to each of the respective strings; and controlling the constant current circuits through a common input line of respective ones of the constant current circuits.

9. The current deviation compensating method of claim 8, further comprising the step of:

setting a current amount to be applied to each of the respective strings using the plurality of constant current circuits.

10. The current deviation compensating method of claim 8, further comprising the step of:

controlling a power supply so that a uniform current amount is applied to each of the respective strings using the plurality of constant current circuits.

11. The current deviation compensating method of claim 8, wherein each of the respective strings of the at least one LED array are connected in parallel.

12. The current deviation compensating method of claim 11, wherein the plurality of constant current circuits are a constant current circuits driven by external power being applied.

13. The current deviation compensating method of claim 11, wherein the plurality of constant current circuits are an LED driving current circuits.

14. The current deviation compensating method of claim 8, further comprising the step of:

compensating for a brightness deviation among each of the respective strings using a plurality of constant current circuits.

15. The method of claim 12, wherein the applied external power is about 5 volts (V) direct current (DC).

16. The current deviation compensating circuit of claim 1, wherein the constant current circuits comprise at least one transistor pair; and wherein the plurality of constant current circuits of different LED strings are controlled through a common input line of respective ones of the transistor pairs.

* * * * *